United States Patent [19]

Butt et al.

[11] Patent Number: 4,991,477

[45] Date of Patent: Feb. 12, 1991

[54] CUTTING OF BLOCKS

[75] Inventors: Michael J. Butt, Poole; Nigel L. Hicks, South Petherton; Nicholas P. Lambert, Dorchester, all of England

[73] Assignee: Wright Pugson Limited, England

[21] Appl. No.: 442,631

[22] Filed: Nov. 29, 1989

[30] Foreign Application Priority Data

Dec. 6, 1988 [GB] United Kingdom ..... 8828441-9

[51] Int. Cl.[5] ..... B26D 1/553; B26D 7/06

[52] U.S. Cl. ..... 83/35; 83/404; 83/418; 83/932; 83/651.1

[58] Field of Search ..... 83/35, 704, 705, 708, 83/719, 720, 651.1, 418, 404, 404.1, 404.2, 404.3, 404.4, 932 , 733, 425.1, 425.3; 99/537

[56] References Cited

U.S. PATENT DOCUMENTS

| | | | |
|---|---|---|---|
| 33,260 | 9/1861 | Moller | 83/35 X |
| 2,238,805 | 4/1941 | Potterweich | 83/404.2 X |
| 2,248,296 | 7/1941 | Campbell | 83/404.2 X |
| 2,717,012 | 9/1955 | Schneider | 83/719 X |
| 3,217,768 | 11/1965 | Lamb | 83/404.2 |
| 3,570,563 | 3/1971 | Hall | 83/719 |
| 4,392,403 | 7/1983 | Martindale, Jr. | 83/418 |
| 4,456,116 | 6/1984 | Jarman | 83/418 X |
| 4,646,602 | 3/1987 | Bleick | 83/651.1 |

*Primary Examiner*—Hien H. Phan
*Assistant Examiner*—Ken Peterson
*Attorney, Agent, or Firm*—Larson and Taylor

[57] ABSTRACT

This invention is a machine and method (10) for cutting large blocks (12) of material, such as cheese, in which a block (12) is pushed in the same direction through successive cutting stations (34,66), the block (12) being rotated between two successive cutting stations (34,66). The machine may have a number of piston and cylinder assemblies (24,32,48,54,68) arranged for pushing the block of cheese through the successive cutting stations, for rotating the block of cheese as described above and for raising and lowering the block of cheese relative to the cutting stations. The machine and method (10) speeds up the cutting process by allowing the simultaneous cutting of two blocks of material.

15 Claims, 4 Drawing Sheets

CUTTING OF BLOCKS

FIELD OF THE INVENTION

The present invention relates to the cutting of blocks, such as blocks of cheese.

DESCRIPTION OF THE PRIOR ART

When cutting a large block of cheese into smaller blocks, it is normally necessary to cut the block in at least two different directions in order to get the right size of smaller block. In existing cheese cutting systems, a large block of cheese is pushed in one direction through a cutting station, which cuts the cheese in one direction, and then is pushed in a different direction through another cutting station to achieve the second cut. In some cases, one of those cuts will cut the block in parallel to two different planes. Thus, if this is the first cut, the block will be divided into long strips which are then subdivided by the second cut.

The disadvantage with such existing systems, however, is that the mechanical apparatus necessary to push the blocks is bulky, and will project from the system in two different directions. Therefore, the cutting apparatus of the system will occupy a large amount of space, which is undesirable. Furthermore, the processing speed of existing systems is limited by the layout of those systems.

SUMMARY OF THE INVENTION

The present invention therefore proposes a block cutting system in which a block is pushed in the same direction through successive cutting stations, the block being rotated between one cutting station and another. The present invention relates to both apparatus and method aspects of this.

Preferably the pushing of the block is achieved by two pushers, one of which pushes the block through the first cutting station and the second pushes the block through the other cutting station. These pushers will normally be hydraulic or pneumatic cylinders or some other linear actuator, and in order to achieve the aim that the pushers push in the same direction, it is preferable that the actuator of one pusher is off-set relative to the other, and acts on a head which bears on the block. That off-set may be horizontal or vertical. There may be one or more supports for blocks being cut, which are movable transverse to the direction of movement of the block of material so that the blocks can be raised or lowered with respect to the cutting stations. Positioning means may be provided to accurately position the blocks for passing through the cutting stations.

The rotation of the block may be achieved by a support being in the form of a plate rotatable about a vertical axis generally transverse to the direction of movement of the part or all of a block of material through successive cutting stations.

A head is normally attached to the end of each pusher, and the head of one of the first and second pushers may be raised from its operative position for pushing the block. Where the head of the second pusher may be raised (and this is the preferred option) this allows a second block to be pushed through the first cutting station whilst simultaneously pushing a first block through the second cutting station.

The cutting stations may comprise cutting frames with one or more horizontally extending cutting edges and/or one or more vertically extending cutting edges.

The heads may be divided into a plurality of sections so that they can partially pass through such cutting frames.

Either or both of the first and second pushers may comprise a pair of actuators arranged to push in opposite directions.

The off-set actuator may be the pusher for the second cut, since its off-set position may enable its pushing head to be raised out of the line of the push when it is not acting (because the first pusher is pushing the block through the first cutting station). Thus, with this arrangement, the second pusher head will be out of position and the first pusher pushes the block through the first cutting station. Then after the block has been rotated, the second pusher head will be lowered into position, with its head behind the cut block, and will then commence to act.

Although we have described above the second pusher being a linear actuator in the form of a cylinder, it may comprise two cylinders or two other actuators acting on opposite ends of a bar (which comprises the head) to prevent the bar bending under load.

One preferred feature of the present invention concerns the case where the block is cut in more than one plane when passing through the first cutting station, and in particular, is cut in half in one direction, and into elongate strips in another. In that case, it is preferable that one half of the block is pushed through the second cutting station before the other (because certain configurations of second cut can only be achieved by cutting less than a complete block at a time), and therefore it is preferable that the second pusher push one half through the second cutting station and then be withdrawn to push the second half through the second cutting station. To do this it would be possible to move the pusher, but the presently preferred arrangement is for the mechanism that causes the rotation of the block also to permit the block to be raised and lowered relative to the second cutting station.

Thus, the top half of the block may be pushed by the second pusher through the second cutting station, the second half of the block then being raised to the position formerly occupied by the first half, and then that second half pushed through the second cutting station. This principle can, of course, be varied to suit blocks cut into more than two pieces in the horizontal plane, and indeed to pieces of unequal size.

In such an arrangement, it can be appreciated that as the second pusher pushes the block through the second cutting station, it empties the space to be occupied by a block passing through the first cutting station. Therefore, the present invention permits one block to be pushed through the first cutting station at the same time as a previous block (or part of a previous block) is being pushed through the second cutting station. This speeds up the processing of blocks, and could not be achieved in a system where the blocks are pushed at different angles through successive cutting stations, because then the space to be occupied by one block would be obstructed by an earlier block throughout the whole of the cutting of that earlier block.

BRIEF DESCRIPTION OF THE DRAWINGS

An embodiment of the invention will now be described in detail, by way of example, with reference to the accompanying drawings, in which.

DETAILED DESCRIPTION OF THE INVENTION

Figure 1:
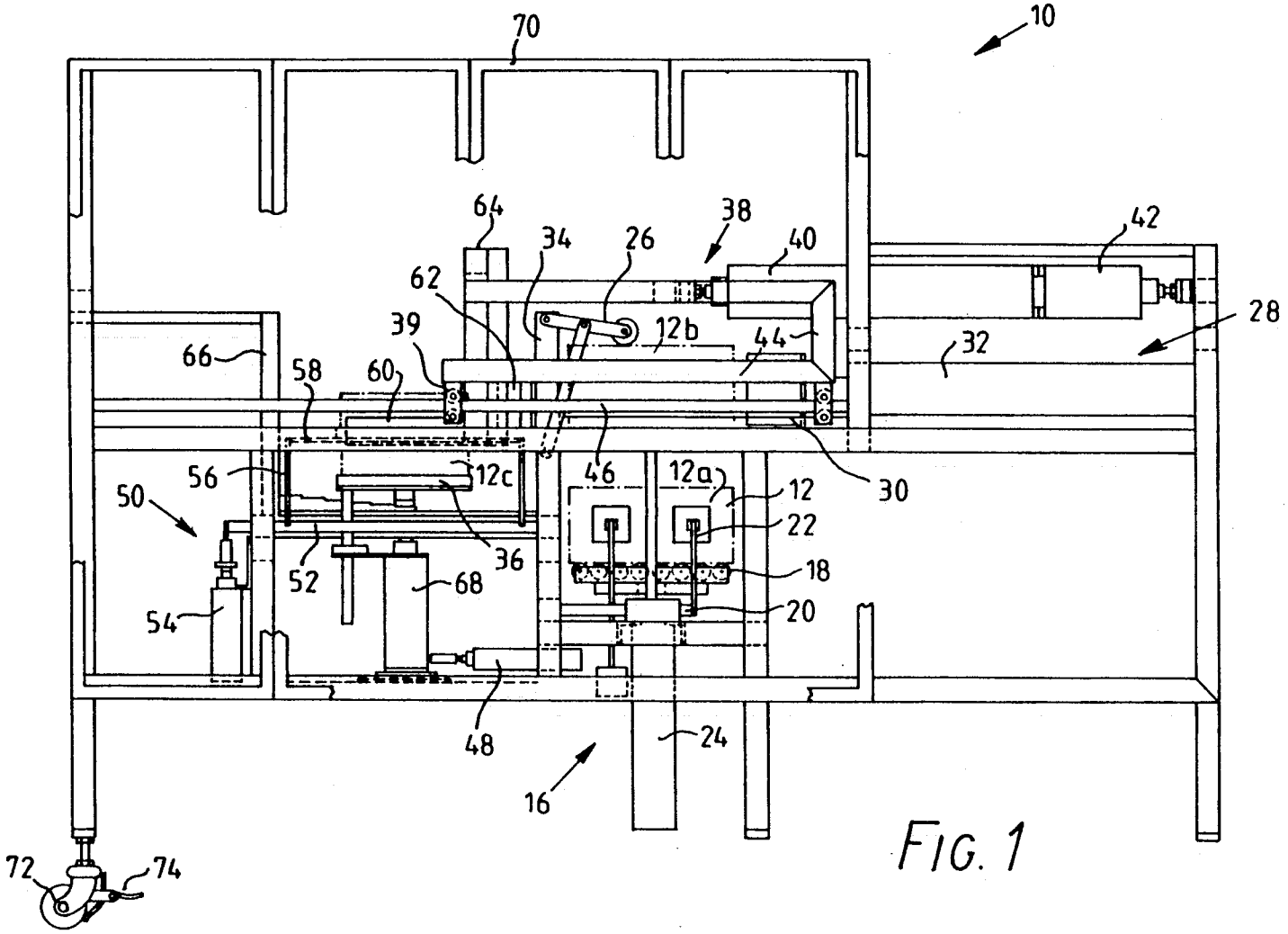
FIG. 1 shows a side view of a first embodiment of a cutting system according to the present invention.
Figure 2:
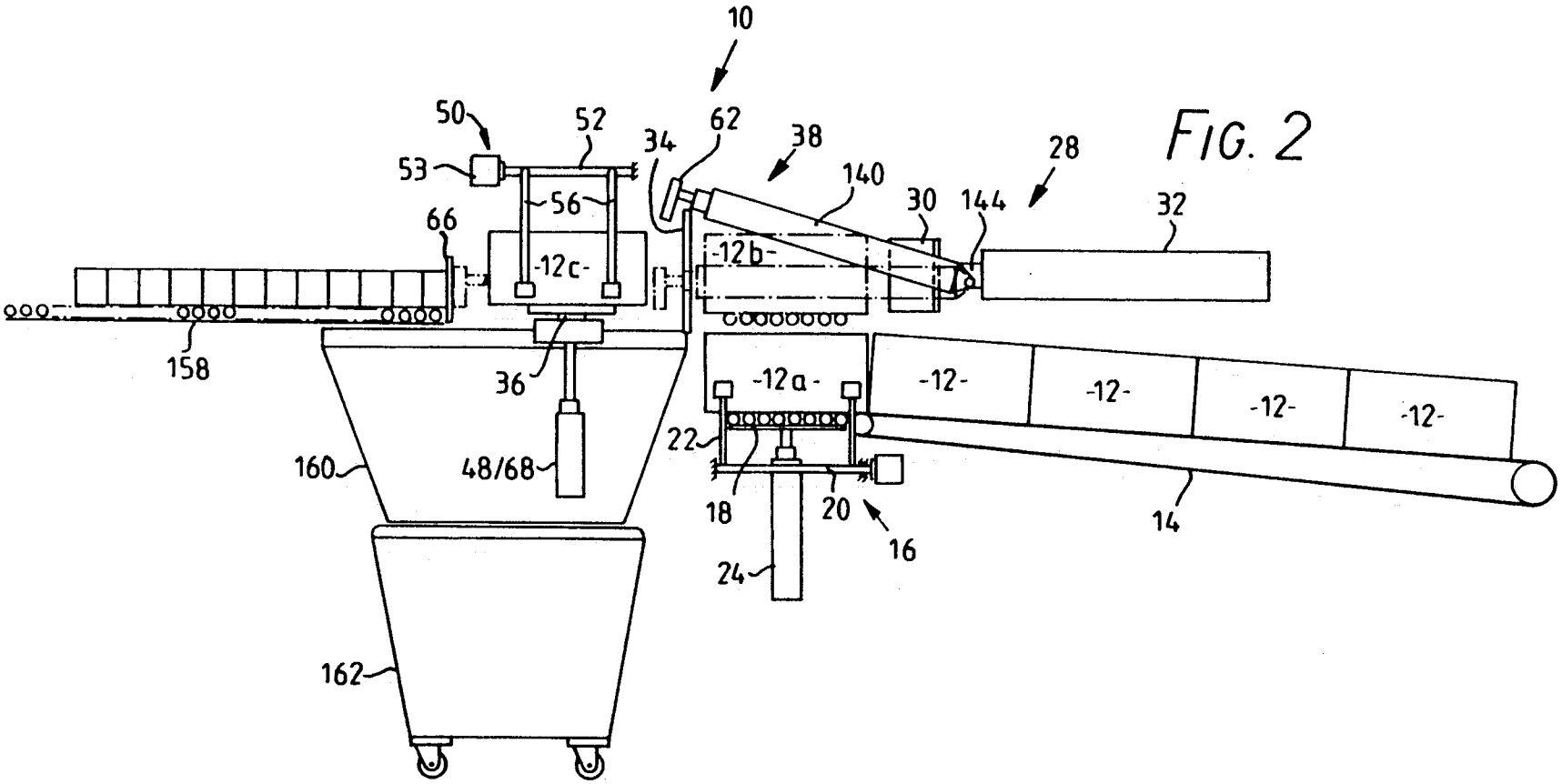
FIG. 2 shows a side view of a second embodiment of a cutting system according to the present invention.

Referring first to FIG. 1, a cutting system 10 according to the present invention is designed to cut large blocks of cheese, from manufacture, into smaller blocks for packaging and marketing. Large blocks of cheese 12 are delivered to a lifting station 16 by a delivery assembly (not shown in FIG. 1). As can be seen by reference to FIG. 2 showing a second embodiment of this invention, the delivery assembly may comprise a conveyor 14 of types well known in the art. The lifting station 16 has a conveyor such as a roller conveyor 18 onto which the blocks 12 roll from the conveyor 14 (the position of one such block is shown at 12*a*). Once on that roller conveyor 18, the block in position 12*a* is centered to the desired position by a centering device 20, comprising arms 22 which bear against the block 12*a*, controlled by a suitable drive. If the block at position 12*a* is initially out of the correct location on the roller conveyor 18, the pivoting of the arms 22 pushes the block 12*a* into the correct location between those arms 22.

Once the block 12*a* is in the correct location on the roller conveyor 18, an actuator in the form of a hydraulic or pneumatic piston and cylinder 24 raises the roller conveyor 18, and hence the block 12*a* on it, to a position where it is ready for the first cut. The position of such a block is shown at 12*b*, although of course, blocks in positions 12*a* and 12*b* would not be present simultaneously. The correct height position of the block in this position 12*b* is controlled by a height sensing device 26 in the form of a wheel and bar arrangement. The height sensing device 26 determines the height of the block 12*a* in order to position e.g. a halving wire correctly.

As the block 12*a* is raised on the roller conveyor 18 the top of block 12*a* comes into contact with the wheel of the height sensing device. The wheel is mounted on pivoted arms and therefore when the block 12*a* is fully elevated it takes up a position which relates to the height of the particular block 12*a* in elevated position on the roller conveyor 18.

Once the block has been raised to position 12*b*, it is acted on by a first pusher 28. This pusher 28 has a pushing head 30, connected to a further actuator in the form of a hydraulic or pneumatic piston and cylinder 32 which, as illustrated, is positioned so as to push the block at 90° to the direction the block has been moved by the piston and cylinder 24. Thus, as the piston and cylinder 32 forces the pushing head 30, and hence the block 12*b* to the left in FIG. 1, the block 12*b* is rolled off the roller conveyor 18.

Figure 4A:
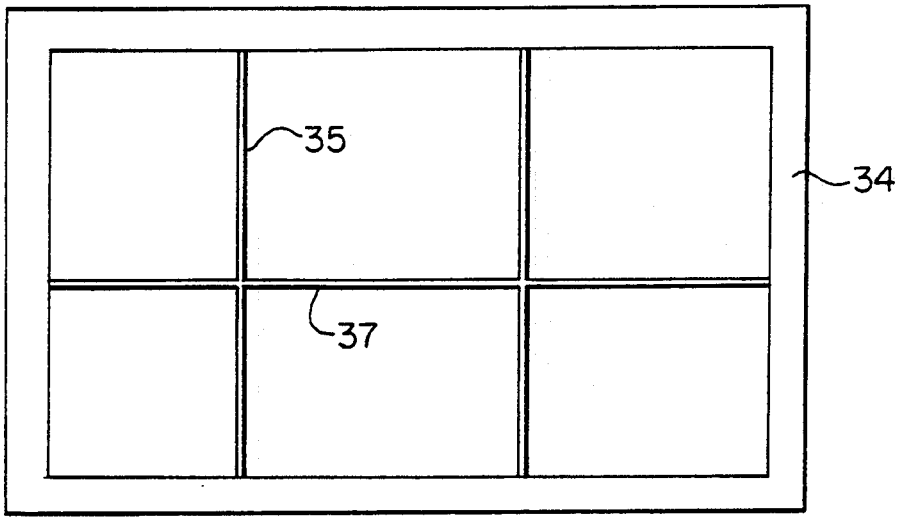
FIGS. 4*a* and 4*b* are schematic end views of cutting frames used in two different embodiments of the cutting system of the invention.
Figure 4B:
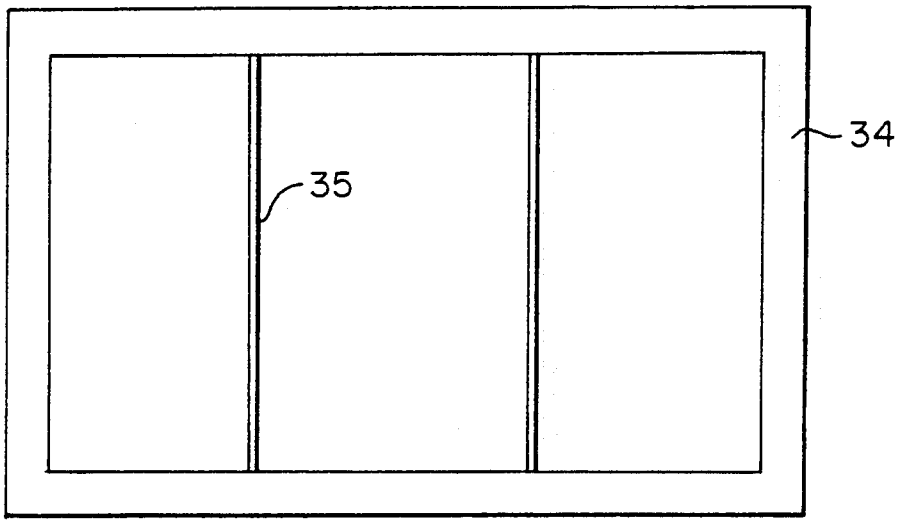

Positioned in the line of the movement of the block 12*b* when pushed by the piston and cylinder 32 is a first cutting station formed by a frame 34. This frame 34 comprises a plurality of vertical cutting wires or blades 35 (see FIGS. 4*a* and 4*b*), to divide the block at position 12*b* into a series of vertically extending strips. Preferably, the cutting frame 34 has one or more horizontally extending cutting wires or blades 37 (see (FIGS. 4*a*) which cut the block 12*b* horizontally in half (or more sections) as it is pushed through the frame 34 by the cylinder 32. Of course, the spacing of the cutting wires or blades and therefore the number of pieces into which the block is cut may be selected as desired.

By means of a mechanical linkage between the wheel and bar arrangement of the height sensing device 26 and the cutting frame 34, the vertical position of the cutting frame 34 is adjusted to correspond to the height of a particular block 12*a* in elevated position on the roller conveyor 18 before the block 12*a* is pushed through the cutting frame 34. This ensures that the horizontal halving wire across the cutting frame exactly halves the block despite variations in block height.

Figure 3:
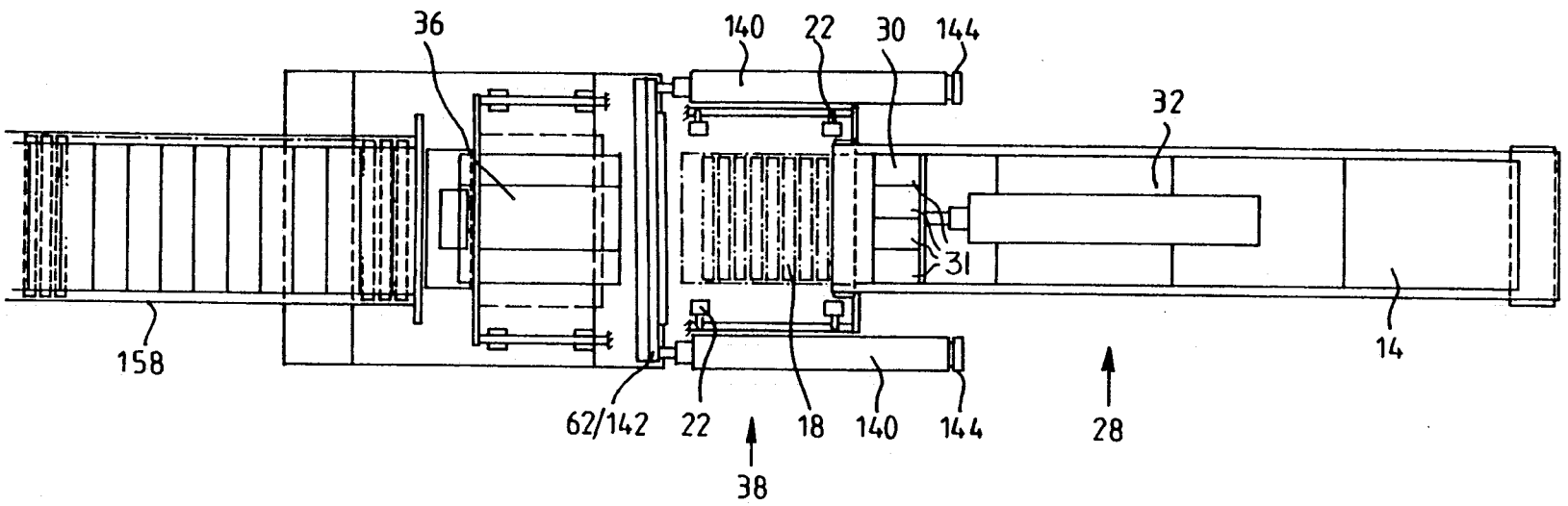
FIG. 3 shows a plan view of the cutting system of FIG. 2.

As can best be seen by reference to FIG. 3 showing the second embodiment of this invention, the pushing head 30 is divided into a plurality of sections 31 corresponding to the divisions of the cutting frame 34, so that the pushing head 30 may partially extend through the cutting frame 34 at the maximum extent of the piston and cylinder 32, to ensure that the whole of the block 12*b* is pushed through the first cutting frame 34. Once that has happened, the piston and cylinder 32 acts to withdraw the pushing head 30. When the block has been pushed fully by the pusher 28 through the cutting frame 34, the block is then supported on a support plate 36 (in its raised position).

Once a block 12 has been pushed through the first cutting frame 34, the first pusher 28 is withdrawn clear of the cutting frame 34. The next step that occurs is that the support plate 36 is rotated through 90°, and its height relative to the cutting frames may also be adjusted. The rotation of the support plate 36 is achieved by operation of a further actuator 48.

The support plate 36 is positioned at the correct height for a specific block. This is achieved by electronically recording the position of the wheel of the height sensing device 26 and then passing an appropriate signal to the height control mechanism associated with the support plate 36.

However, before the second pusher 38 can operate, a block in position 12*c* must be positioned accurately ready for the second cut, and this is achieved by a centering device shown generally at 50, which is similar to the centering device 16 described earlier. The centering device 50 comprises a transverse bar 52 located beneath the block of cheese 12, which may be caused to rotate by the operation of an actuator 54 (again in the form of a hydraulic or pneumatic piston and cylinder). A pair of arms 56 extend upwardly from the transverse bar 52 towards the block of cheese in position 12*c*. The ends of the arms 56 away from the transverse bar 52, are connected by a second transverse bar 58 which supports a plate 60 for locating against the side of a cheese block 12*c*.

Rotation of the transverse bar 52 by the actuator 54 causes the plate 60 to move against the block of cheese 12*c*, guiding the block into a suitable position for the next cutting stage effected by the second pusher 38.

The second pusher 38 comprises a pair of actuators in the form of first 40 and second 42 hydraulic or pneumatic pistons and cylinders. These first 40 and second 42 actuators are arranged for operation in opposite directions with respect to each other.

The actuator system 40,42 of the second pusher 38, is slidably mounted on a rail 46 via arms 44 which extend from the actuator system and which terminate in feet 39 mounted on the rail 46. The rail 46 extends along part of the longitudinal length of the cutting system 10.

The head 62 of the second pusher 38 is mounted between the arms 44 of the actuator system 40,42.

The respectively facing inside surfaces of the arms 44 bear upright pillars 64 which support two upright rodless cylinders (hidden in FIG. 1 by the pillars 64). The head 62 is located transversely between the rodless cylinders and upright pillars 64.

By means of suitable actuators e.g. the rodless cylinders, the head 62 of the second pusher 38 can be raised and lowered. Thus the head 62 of the second pusher can be lifted out of the line of cut of the first pusher 28 during the first stage of the cutting operation and then lowered into position for operation during the second stage of the cutting operation.

While the block is being centered, as described above, the head 62 of the second pusher 38 is lowered to a position immediately behind the block, in its position 12*c*. The second pusher 38 then pushes the block from position 12*c* for the second cutting operation to occur.

As was mentioned above, however, block reaching position 12*c* has been cut horizontally into two halves, as this permits certain desired cut configurations to be made. For this reason, it is desirable for the two halves to be pushed separately through a second cutting frame 66 and FIG. 1 illustrates a mechanism for dealing with this. The support plate 36 is mounted on a hydraulic or pneumatic piston and cylinder 68 (or other actuator) which raises or lowers the support plate 36, and hence a block on it relative to the position of the second cutting frame 66. The support plate 36 can be lowered or raised so that either of the two halves created during the first cutting stage is aligned with the plane defined by the head 62 of the second pusher 38 in operating position and the second cutting frame 66 (i.e. the block may be lowered or raised by half its thickness). Thus, the head 62 may first act on the top half of the block to push it through the second cutting frame 66. This divides the strips into which the block has been cut into small blocks. These small blocks are pushed to lie on a conveyor, the end of which is immediately adjacent the second cutting frame 66. The small blocks may then be carried to e.g. a wrapper (not shown). Once the top half of a block has been pushed through the second cutting frame 66, the head 62 is withdrawn, by withdrawal of the second pusher 38 (see later), and then the piston and Cylinder 68 raises the support plate 36 so that the lower half of the block is aligned between the head 62 and second cutting frame 66. That lower half can then be pushed through the cutting frame 66 by the head 62, as the second pusher 38 pushes the head 62 to the left in FIG. 1.

As the head 62 of the second pusher 38 can be raised out of the cutting line of action of the first pusher 28, one block 12 can be cut through the first frame 34 whilst the second half of an earlier block is being cut by the second frame 66.

As previously described, the second pusher 38 comprises first 40 and second 42 actuators arranged to move in opposite directions to each other. The actuators 40 and 42 are hydraulic or pneumatic piston and cylinders. They are approximately equal in power so that the actuator 42 is not forced in when actuator 40 outstrokes. During the cutting stage both actuators 40, 42 outstroke together, but on the return actuator 42 instrokes first, withdrawing the head from the frame followed by the lifting action of the rodless cylinders. Then actuator 40 instrokes. As can be seen in FIG. 1 the cutting system 10 may be mounted in a support frame. This support frame may be mounted on wheels 72 provided with brakes 74.

FIGS. 2 and 3 show a second embodiment of the present invention which has a different design of second pusher 38. The same reference numerals are used where features are common to both embodiments. As can best be seen from FIG. 3, the second pusher 38 in this embodiment comprises first and second hydraulic or pneumatic pistons and cylinders 140 which act on the head 62 in the form of a bar 142 which locates transversely between the ends of the pistons and cylinders 140. The pistons and cylinders 140 are secured to a pivot 144 at their ends remote from the bar 142, so that, as can be seen from FIG. 2, the second pusher 38 may be pivoted about the pivots 144 to raise the bar 142 clear of the line of movement of the block from position 12*b* to position 12*c* as it is acted on by the first pusher 28. FIG. 3 also shows that the pistons and cylinders 140 are laterally displaced relative to the line of action of the piston and cylinder 32, so that there is room for a block to rise to position 12*b* between them.

It may be appreciated that, because the pistons and cylinders 140 are offset, and hence there is a space between them, the pushing of the second half of a block at position 12*c* through the second cutting frame 66, makes free the space that will be occupied when a subsequent block is pushed through the first cutting frame 34 by the first pusher 28. Therefore, the system may be operated such that a subsequent block is being pushed through the first cutting frame 34 at the same time as the second half of a block in position 12*c* is being pushed through the second cutting frame 66. Of course, it will be appreciated that if the block at position 12*c* is not divided into two, or is pushed as a single unit, then the pushing of a subsequent block through the first cutting frame 34 can occur as the whole of the earlier block is being pushed through the second cutting frame 66. This is made possible because the pistons and cylinders 140 are articulated about the pivot 144 enabling them to be raised clear of the block in position 12*c* so allowing them to return the second pusher 38 to its withdrawn position.

In this second embodiment, the centering device 50 which positions the block 12*c* in preparation for the second cut, differs from the centering device 50 of the first described embodiment. In this second embodiment, the centering device 50 is broadly similar to the centering device 20 already described. Thus it comprises a pair of arms 56 which bear against the block, controlled by a suitable drive 53. The pair of arms 56 extend downwardly from a transverse bar 52 located above the block of cheese 12*c*. The drive 53 operates to cause the arms to bear against the block and direct the block into a suitable position for the next cutting stage.

FIG. 2 also shows an optional trim chute 160 positioned below the area of cutting, extending from the first cutting frame 34 to a short distance along the conveyor 158, to catch any slivers of cheese and return them to a hopper 162.

Thus, the present invention permits the cutting of cheese, or other blocks, into smaller blocks with the blocks moving linearly. This gives two particular advantages. Firstly, the use of the fact that the block is turned as it is on the support plate 36 enables the cheese to be cut on two faces whilst being pushed in the same line. This significantly reduces the space requirement for the system 10 as a whole. Secondly, the fact that the head 62 of the second pusher 38 can be raised out of the line of action of the first pusher 28, means that one block can be cut through the first cutting frame 34 whilst the second half of an earlier block is being cut by the second cutting frame 66. This reduces the time involved in the cutting operation.

The present invention may be used, for example, for cutting 40 lb blocks of cheese into small portions. Of course, the present invention is not limited to the cutting of cheese, and may be applied to other soft block material.

Whereas the invention has been described with reference to preferred embodiments, the skilled reader will appreciate that many changes and modifications are possible within the spirit and scope of the invention. It is intended to cover all such changes and modifications by the following claims.

What we claim is:

1. A machine for cutting a block of material having at least first and second surfaces disposed opposite each other and being of a pre-determined size, said machine comprising:

a first cutting station having a first cutting frame, said first cutting frame defining an opening through which said block is to be pushed in a first direction of movement, said first cutting frame including cutting members disposed in said opening for cutting said block;

a first pusher having a head aligned with said first cutting frame such that said block is locatable between said head of said first pusher and said first cutting frame with said first surface of said block facing said first cutting frame and said second surface of said block facing said head of said first pusher, and such that actuation of said first pusher causes said block to be pushed through said opening of said first cutting frame with said head being on said second surface of said block;

a second cutting station having a second cutting frame, said second cutting frame defining a further opening through which at least a part of said block is to be pushed in a second direction of movement, said second cutting frame including further cutting members disposed in said further opening for cutting at least part of said block;

a rotatable member disposed between said first and said second cutting stations and arranged to rotate said block by 90°; and a second pusher having a head movable between a withdrawn position and an active position between said first and second cutting frames, said head of said second pusher being aligned with said second cutting frame such that said at least a part of said block is located between said head of said second pusher and said second cutting frame, such that actuation of said second pusher, when said head is in said active position, causes said at least a part of said block to be pushed through said further opening;

said first and second pusher being arranged such that the first direction of movement of said block through said first cutting frame and the second direction of movement of said at least a part of said block through said second cutting frame are the same.

2. A machine according to claim 1 wherein the machine also comprises one or more supports for said parts or all of a block of material, which are movable transverse to the direction of movement of the part or all of a block of material between successive cutting stations.

3. A machine according to claim 1 wherein the machine also comprises positioning means to align the part or all of a block of material with the cutting stations.

4. A machine according to claim 1 wherein the rotatable member comprises a support in the form of a plate which is rotatable about a vertical axis generally transverse to the direction of movement of the part or all of a block of material through successive cutting stations.

5. A machine according to claim 1 wherein the cutting member has at least one vertically extending cutting edge.

6. A machine according to claim 1 wherein the further cutting member has at least one horizontally extending cutting edge and at least one vertically extending cutting edge.

7. A machine according to claim 1 wherein the head of the first pusher is divided into a plurality of sections.

8. A machine according to claim 1 wherein the pushing assembly comprises at least one hydraulic or pneumatic piston and cylinder assembly.

9. A machine according to claim 1 wherein the cutting member has at least one horizontally extending cutting edge and at least one vertically extending cutting edge.

10. A machine according to claim 1 wherein either or both of said first and second pushers comprise a pair of pushers arranged to push in opposite directions.

11. A machine according to claim 1 wherein the further cutting member has at least one vertically extending cutting edge.

12. A method of cutting a block of material having at least first and second surfaces disposed opposite each other and being of a predetermined size using apparatus comprising, at a first cutting station, a first pusher having a head and a first cutting frame in alignment with said head and including first cutting members for cutting said block and, at a second station, a second pusher having a head and a second cutting frame in alignment with said head of said second pusher and including second cutting members for cutting said block, said method comprising:

locating said block of material between said head of said first pusher and said first cutting frame with said first surface of said block facing said first cutting frame and said second surface of said block facing said head of said first pusher, said first cutting frame defining an opening through which said block is pushed in a first direction of movement for cutting by said first cutting members;

actuating said first pusher to cause said block to be pushed through said opening of said first cutting frame to provide cutting of said block by said first cutting members, with said head being on said second surface of said block;

rotating said block by 90° after the block has been pushed through said opening of said first cutting frame;

locating at least part of said block of material, after said rotation, between said head of said second pusher and said second cutting frame, said head of said second pusher being movable between a withdrawn position and an active position between said first and second cutting frames and said second cutting frame defining a further opening through which said at least part of said block is pushed in a second direction of movement for cutting of said block by said second cutting members;

actuating said second pusher with said head in said active position to cause said at least part of said block to be pushed through said further opening to provide cutting of said at least a part of said block by said second cutting members, said first direction of movement of said block through said first cutting frame and said second direction of movement of said at least a part of said block through said second cutting frame being the same.

13. A method according to claim 12 which additionally comprises accurately positioning the part or all of the block for passing through successive cutting stations.

14. A method according to claim 12 which comprises pushing part or all of a second block of material through a first cutting station whilst simultaneously pushing part or all of an earlier first block of material through a second cutting station.

15. A method according to claim 12 which additionally comprises raising or lowering the part or all of a block of material relative to the cutting stations.

* * * * *